US007346303B2

(12) United States Patent
Okabe

(10) Patent No.: US 7,346,303 B2
(45) Date of Patent: Mar. 18, 2008

(54) IMAGE FORMING APPARATUS HAVING PLURAL IMAGE CARRIERS FOR SUPERIMPOSINGLY TRANSFERRING IMAGES

(75) Inventor: Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 266 days.

(21) Appl. No.: 11/076,980

(22) Filed: Mar. 11, 2005

(65) Prior Publication Data

US 2005/0207798 A1 Sep. 22, 2005

(30) Foreign Application Priority Data

Mar. 16, 2004 (JP) ..... 2004-074778

(51) Int. Cl.
*G03G 15/01* (2006.01)

(52) U.S. Cl. ..... 399/299

(58) Field of Classification Search ..... 399/288, 399/299

See application file for complete search history.

(56) References Cited

U.S. PATENT DOCUMENTS 5,497,225 A * 3/1996 Matsuzuki ..... 399/223

FOREIGN PATENT DOCUMENTS

JP A 11-119502 4/1999

* cited by examiner

*Primary Examiner*—David M. Gray
*Assistant Examiner*—Ruth N LaBombard
(74) *Attorney, Agent, or Firm*—Oliff & Berridge, PLC

(57) ABSTRACT

In a color laser printer, in which phases of periodic variations in abutting position speeds of photoconductor drums and timings of transfer of toner images to a medium are synchronized, the variation in speed of the medium due to periodic variations of the abutting position speeds are reduced. In the color laser printer, in which a medium is moved while being abutted by four photoconductor drums, and thereby toner imaged carried by the photoconductor drums are superimposingly transferred to the medium, the photoconductor drums are arranged such that the distance between neighboring two abutting positions of the photoconductor drums with the medium is three or five times a value obtained by dividing a circumferential length of the outer circumferential surface of each of the image carriers by the number of the carriers.

10 Claims, 13 Drawing Sheets

ABUTTING POSITION SPEED
3Y
3M
3C
3Bk
T1
T2
T3
T4
TRANSFER TIMING
TRANSFER TIMING
TRANSFER TIMING
TRANSFER TIMING
CANCEL WITH EACH OTHER
CANCEL WITH EACH OTHER
t (TIME)

DRIVING FORCES APPLIED TO INTERMEDIATE TRANSFER BELT
RESULTANT FORCE OF DRIVING FORCES
DRIVING FORCE BY ONE PHOTOCONDUCTOR DRUM
t (TIME)

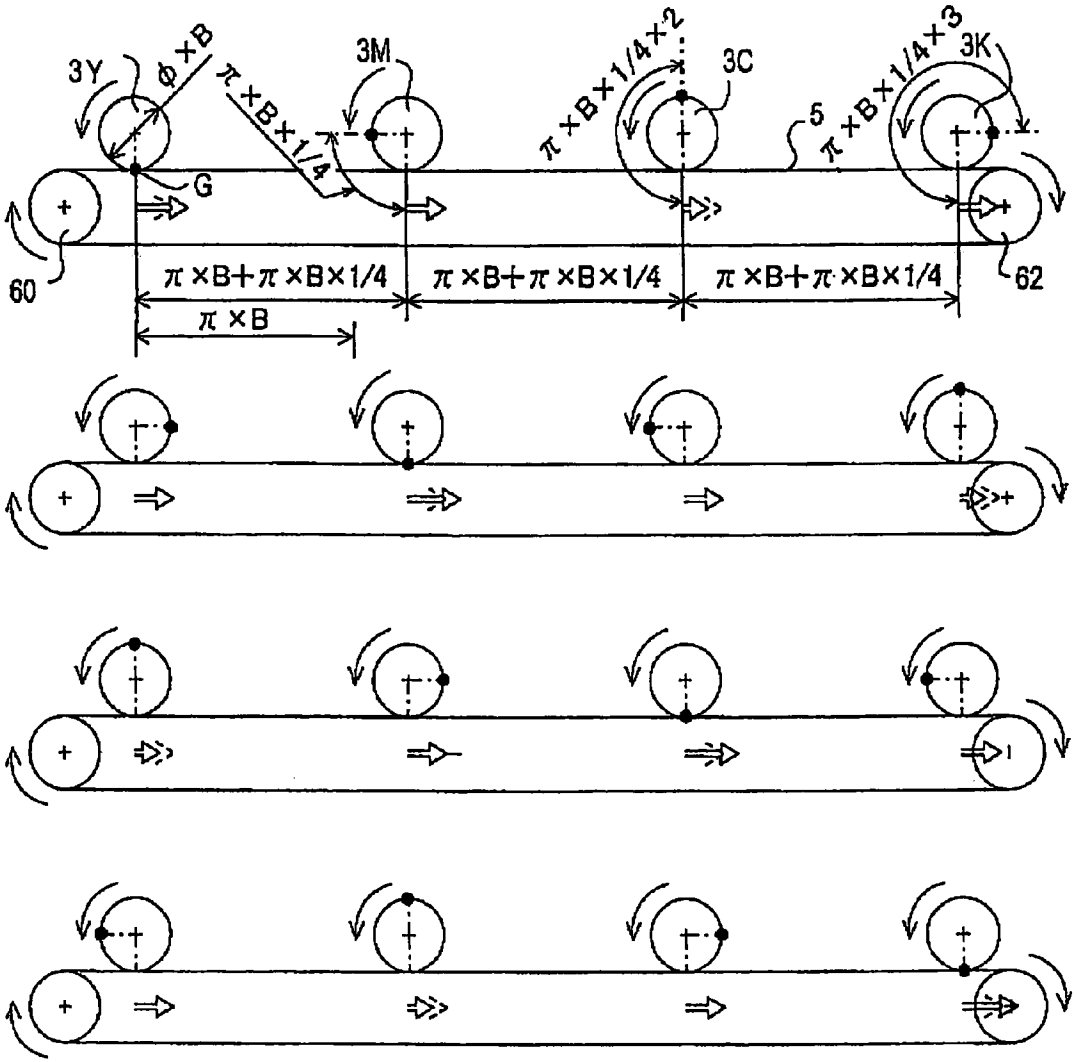
FIG.6A T1
FIG.6B T2
FIG.6C T3
FIG.6D T4

ABUTTING POSITION SPEED
T1
T2
T3
T4
3Y
3M
3C
3Bk
t (TIME)
TRANSFER TIMING
CANCEL WITH EACH OTHER
TRANSFER TIMING
CANCEL WITH EACH OTHER
TRANSFER TIMING
TRANSFER TIMING
RESULTANT FORCE OF DRIVING FORCES

DRIVING FORCES APPLIED TO INTERMEDIATE TRANSFER BELT
t (TIME)
DRIVING FORCE BY ONE PHOTOCONDUCTOR DRUM

ABUTTING POSITION SPEED
3Y
3M
3C
3Bk
T1
T2
T3
T4
TRANSFER TIMING
TRANSFER TIMING
TRANSFER TIMING
TRANSFER TIMING
CANCEL WITH EACH OTHER
CANCEL WITH EACH OTHER
t (TIME)

DRIVING FORCES APPLIED TO INTERMEDIATE TRANSFER BELT
RESULTANT FORCE OF DRIVING FORCES
DRIVING FORCE BY ONE PHOTOCONDUCTOR DRUM
t (TIME)

0° / T1

90° / T2

180° / T3

270° / T4

ABUTTING POSITION SPEED
3Y
3M
3C
3Bk
T1
T2
T3
T4
MAXIMUM POINT G
TRANSFER TIMING
TRANSFER TIMING
TRANSFER TIMING
TRANSFER TIMING
t (TIME)

DRIVING FORCES APPLIED TO INTERMEDIATE TRANSFER BELT
RESULTANT FORCE OF DRIVING FORCES
DRIVING FORCE BY ONE PHOTOCONDUCTOR DRUM
t (TIME)

IMAGE FORMING APPARATUS HAVING PLURAL IMAGE CARRIERS FOR SUPERIMPOSINGLY TRANSFERRING IMAGES

CROSS-REFERENCE TO RELATED APPLICATIONS

This application claims the benefit of Japanese Patent Application No. 2004-74778 filed Mar. 16, 2004 in the Japan Patent Office, the disclosure of which is incorporated herein by reference

BACKGROUND

The present invention relates to an image forming apparatus configured to form an image by superimposingly transferring visual images carried by a plurality of image carriers onto a recording medium carried by a conveyer member or an intermediate transfer body.

An example of a conventional image forming apparatus is a so-called intermediate transfer tandem printer. In such an image forming apparatus, a plurality of image carriers carrying visual images (developing agent images) on the outer circumferential surfaces thereof are rotatably supported and spaced substantially evenly apart. A drive device rotates the image carriers in respective circumferential directions. A visual image forming device forms visual images on the outer circumferential surfaces of the respective image carriers, in synchronization with the rotation of the image carriers. A conveyer device keeps an intermediate transfer body in abutment with the image carriers while moving the intermediate transfer body at a speed in accordance with the moving speeds of the outer circumferential surfaces of the image carriers, so as to superimposingly transfer the visual images formed on the respective image carriers at abutting positions between the intermediate transfer body and the image carriers.

In the above image forming apparatus, periodic variations are caused in the moving speeds of the outer circumferential surfaces of the image carriers at the abutting positions between the respective image carriers and the intermediate transfer body (hereinafter referred to as "abutting position speeds") due to variations in the outer configurations of the image carriers.

Specifically, when each of the image carriers has a drum-like configuration, variations in the roundness of the outer shape lead to differences in the distance from the rotation axis to the outer circumferential surface. Then, the moving speed of a portion distant from the rotation axis is faster than the moving speed of a portion close to the rotation axis even if the image carrier is rotated so as to have a constant rotation angle speed. Accordingly, the abutting position speeds vary periodically.

When there are periodic variations in the abutting position speeds in the image forming apparatus, specifically when the abutting position speeds of the image carriers become faster than the moving speed of the intermediate transfer body, an image deviation is caused, in which visual images transferred from the image carriers onto the intermediate transfer body are shortened In contrast, when the abutting position speeds of the image carriers become slower than the moving speed of the intermediate transfer body, an image deviation is caused, in which visual images transferred from the image carrier onto the intermediate transfer body are elongated.

As described above, the periodic variations in the abutting position speeds of the image carriers produce image deviations, thereby causing an adverse effect on an image formed by the image forming apparatus. Since variations in the outer configuration of the image carrier cannot be completely avoided, occurrence of periodic variations in the abutting position speeds of the image carriers should be accepted to some extent.

To reduce adverse effects of image deviations, an image forming apparatus, for example, disclosed in the Publication of Unexamined Japanese Patent Application No. 11-119502 has been provided. In the image forming apparatus, as shown in FIG. 10A, four photoconductor drums 3Y, 3M, 3C and 3Bk as image carriers are arranged to be spaced substantially evenly with respect to an intermediate transfer belt 5 (an intermediate transfer body). The intermediate transfer belt 5 is stretched between a drive roller 62 and a follower roller 60 in an endless manner and is moved in the right direction in the figure by the rotation of the drive roller 62. By rotating the photoconductor drums 3Y, 3M, 3C and 3Bk in synchronization with one another in a counterclockwise direction in the figure, toner images (visual images) carried by the photoconductor drums are superimposingly transferred onto the intermediate transfer belt 5 to thereby form a multicolor image. In this case, the photoconductor drums 3Y, 3M, 3C and 3Bk are arranged at a distance d, corresponding to the circumferential length c (=π×diameter B) of the photoconductor drums 3Y, 3M, 3C and 3Bk, apart from one another.

In the image forming apparatus as above, when the photoconductor drums 3Y, 3M, 3C and 3Bk are arranged such that the orientations of maximum points G, each of which is a position on the circumferential surface where the abutting position speed is the maximum, are in the same orientations, the operation of transferring the toner images from the photoconductor drums 3Y, 3M, 3C and 3Bk onto the intermediate transfer belt 5 is as described below.

To facilitate better understanding, it is assumed here that the abutting position speeds of the photoconductor drums 3Y, 3M, 3C and 3Bk vary in a sinusoidal manner due to eccentricity of the rotation axes of the photoconductor drums 3Y, 3M, 3C and 3Bk or other factors.

As shown in FIG. 10A, the photoconductor drums 3Y, 3M, 3C and 3Bk are in a state in which the maximum points G simultaneously abut the intermediate transfer belt 5 at a point in time (a timing T1). As time passes, the abutting position speeds of the photoconductor drums 3Y, 3M, 3C and 3Bk respectively vary in a sinusoidal manner as shown in FIG. 11A. FIGS. 10B through 10D show respective states of the photoconductor drums 3Y, 3M, 3C and 3Bk at timings T2 through T4, i.e. after each quarter rotation of the photoconductor drums 3Y, 3M, 3C and 3Bk from the timing T1. The orientations of the maximum points G of the photoconductor drums 3Y, 3M, 3C and 3Bk are shifted at the timing T2, T3 and T4 by 90°, 180° and 270°, respectively, with respect to the orientations at the timing T1. When the photoconductor drums 3Y, 3M, 3C and 3Bk are rotated by 360°, the respective maximum points G abut the intermediate transfer belt 5 again in the state as shown in FIG. 10A.

The intermediate transfer belt 5 is moved by the same distance as the circumferential length c of the photoconductor drums 3Y, 3M, 3C and 3Bk while the photoconductor drums 3Y, 3M, 3C and 3Bk are rotated by 360°. Accordingly, the phases of periodic variations in the abutting position speeds of the photoconductor drums 3Y, 3M, 3C and 3Bk and timings, at which the toner images on the photoconductor drums 3Y, 3M, 3C and 3Bk are transferred onto the intermediate transfer belt 5, are synchronized with each other.

Then, points on the intermediate transfer belt 5 at which transferred toner images are slightly shortened or elongated coincide with one another.

The above image forming apparatus can reduce deviation among visual images to be superimposed to thereby form a clear image since the phases of periodic variations in the abutting position speeds and the timings, at which the visual images on the image carriers are transferred onto the intermediate transfer belt, are synchronized with one another.

SUMMARY

In the image forming apparatus as described above, the intermediate transfer body and each of the image carriers abut with each other. When there is a periodic variation in each abutting position speed, a driving force, depending on the difference between the abutting position speed and the speed of the intermediate transfer body due to the periodic variation, may be applied to the intermediate transfer body by friction.

Then, the moving speed of the intermediate transfer body may be changed by the driving force. Specifically, in the case of an image forming apparatus, in which the distance between the image carriers is the same as the circumferential length of the carriers, and the orientations of the maximum points G of the image carriers are the same, as shown in FIGS. 10A through 10D, for example, the photoconductor drums 3Y, 3M, 3C and 3Bk simultaneously abut the intermediate transfer belt 5 at the respective maximum points G at the timing T1. Then, maximum driving forces are applied by the respective photoconductor drums 3Y, 3M, 3C and 3Bk to the intermediate transfer belt 5 in the same direction (in a speed increasing direction). At the timing T3, maximum driving forces in a speed decreasing direction are applied by the respective photoconductor drums 3Y, 3M, 3C and 3Bk to the intermediate transfer belt 5. Accordingly, a resultant force of the driving forces applied to the intermediate transfer belt 5 varies significantly as shown in FIG. 11B.

FIG. 11B shows that the summation of the differences between the speeds of the four photoconductor drums 3Y, 3M, 3C and 3Bk, and the speed of the intermediate transfer belt 5 serves as a force to drive the intermediate transfer belt 5 by the photoconductor drums 3Y, 3M, 3C and 3Bk when the speed of the intermediate transfer belt 5 is lower, while it serves as a force to brake the intermediate transfer belt 5 by the photoconductor drums 3Y, 3M, 3C and 3Bk when the speed of the intermediate transfer belt 5 is higher.

Specifically, the figure shows the variation in the resultant force of forces that are received by the drive roller 62, as a drive source of the intermediate transfer belt 6, from the photoconductor drums 3Y, 3M, 3C and 3Bk. The resultant force sometimes serving as a speed increasing force, while serving as a braking force at other times, will be comprehensively described as "the resultant force of driving forces applied to the intermediate transfer belt 5" for the sake of simplicity (same with respect to the description of a preferred embodiment of the invention).

When such driving forces are applied, the moving speed of the intermediate transfer belt 5 varies, and thereby adverse effects will be exerted on an image to be formed due to deviation of visual images during transfer of toner images from the photoconductor drums 3Y, 3M, 3C and 3Bk.

Although a description has been made concerning an intermediate transfer tandem image forming apparatus, the same problem as above may occur in a so-called direct transfer tandem image forming apparatus, in which a conveyer belt for carrying a recording paper is employed instead of an intermediate transfer belt, and visual images carried by image carriers are superimposingly transferred onto the recording medium carried by the conveyer member.

The present invention, which has been made in view of problems such as the above, has an object to obtain an improved image by reducing the speed variation of an intermediate transfer body or a conveyer member due to periodic variations in abutting position speeds of image carriers in an image forming apparatus.

To attain the above object, in one aspect of the present invention, there is provided an image forming apparatus which comprises: a plurality of image carriers, a driving device, a plurality of visual image forming devices and a conveyer device. The plurality of image carriers which are rotatably supported by rotating shafts carry visual images on outer circumferential surfaces thereof. The driving device rotates the image carriers in circumferential directions. The plurality of visual image forming devices form visual images on the outer circumferential surfaces of the image carriers. The conveyer device moves a medium onto which the visual images are transferred while maintaining abutment of the image carriers with the medium. The conveyer device superimposingly transfers the visual images formed on the outer circumferential surfaces of the image carriers onto the medium, at abutting positions between the medium and the image carriers.

In the image forming apparatus, each of the plurality of image carriers has a rotation axis center and a physical center, as well as an eccentric direction vector having a direction running from the rotation axis center to the physical center. The plurality of image carriers are attached to the rotating shafts such that a sum of the eccentric direction vectors of the plurality of image carriers is equal to 0.

The eccentric direction vector is uniquely determined according to the state which is taken by the rotating image carrier at a certain moment. If the respective image carriers are attached to the respective rotation axes such that the sum of the eccentric direction vectors of the plurality of image carriers is equal to 0, the eccentric direction vectors of the plurality of image carriers becomes 0 as a whole.

In the above image forming apparatus, since the eccentric direction vectors of the respective image carriers are cancelled, neither driving force nor braking force operates between the plurality of image carriers and the medium onto which the visual images are transferred. Accordingly, even if the individual image carriers are eccentrically rotated, the moving speed of the medium onto which the visual images are formed is evenly maintained. Occurrence of deviation in the formed visual imaged is inhibited.

It is preferable that the plurality of image carriers are attached to the rotation shafts such that the eccentric direction vector of one image carrier cancels the eccentric direction vector of another image carrier, of the plurality of image carriers.

In an embodiment of the present invention, the sum of the eccentric direction vectors is basically equal to 0. Furthermore, since variations of frictional forces and driving forces are taken into consideration, precision of image superimposition becomes all the more high.

In view of the above, the following image forming apparatus is provided. That is, an image forming apparatus, in another aspect of the present invention, comprises: a plurality of image carrier, a driving device, a plurality of visual image forming devices and a conveyer device. The plurality of image carriers which are rotatably supported by rotating shafts and substantially equally spaced from one another carry visual images on outer circumferential surfaces thereof. The driving device rotates the image carriers in circumferential directions. The plurality of visual image forming devices form visual images on the outer circumferential surfaces of the image carriers in synchronization with rotations of the image carriers. The conveyer device moves an intermediate transfer body at a speed in accordance with moving speeds of the outer circumferential surfaces of the image carriers while maintaining abutment of the image carriers with the intermediate transfer body. The conveyer device superimposingly transfers the visual images formed on the outer circumferential surfaces of the image carriers onto the intermediate transfer body, at abutting positions between the intermediate transfer body and the image carriers. The present invention may be applicable to a so-called intermediate transfer tandem image forming apparatus.

In the image forming apparatus, the image carriers are attached to the rotating shafts in orientations such that periodic variations in the moving speeds of the outer circumferential surfaces of the image carriers, which are caused at the abutting positions of the image carriers with the intermediate transfer body, have a phase difference between any two of the image carriers corresponding to a time period required for the intermediate transfer body to move between the abutting positions of the two of the image carriers with the intermediate transfer body.

In the image forming apparatus, the visual images formed on the outer circumferential surfaces of the image carriers are superimposingly transferred to the intermediate transfer body at different timings The difference of timings is equal to a time period required for the intermediate transfer body to move between two of the abutting positions of the image carriers with the intermediate transfer body.

Accordingly, in the image forming apparatus, periodical variations in the moving speeds (abutting position speeds) of the outer circumferential surfaces of the image carriers at the abutting positions of the image carriers with the intermediate transfer body and the timings of transfer of the visual images on the image carriers onto the intermediate transfer body are synchronized.

Therefore, elongation or shortening in the visual images formed on the intermediate transfer body, which is caused due to the periodic variations of the abutting position speeds, occurs at corresponding positions of the visual images transferred from the image carriers, so that a clear image with a reduced deviation among the visual images can be obtained.

In the image forming apparatus of the another aspect of the present invention, the image carriers are arranged such that a distance between neighboring abutting positions with the intermediate transfer body is a distance d which is an integral multiple of a value obtained by dividing a circumferential length c of the outer circumferential surface of each of the image carriers by the number A of the image carriers, and which is not an integral multiple of the circumferential length c (i.e. $d=c(M/A+N)$; M is an integer from 1 to "A−1", and N is 0 or an integer).

As a result, the timings of transfer of the visual images onto the intermediate transfer body differ in proportion to the distance between the abutting positions of the image carriers with the intermediate transfer body. Then, in turn, phases of periodic variations in the abutting position speeds of the image carriers in synchronization with the timings of transfer also differ in proportion to the distance between the abutting positions of the image carriers with the intermediate transfer body. By setting the distance between the abutting positions of the image carriers with the intermediate transfer body to a distance d, the phase differences of periodic variations in the abutting position speeds of the image carriers are evenly distributed.

Specifically, when the number A is an odd number, the phases of the periodic variations in the abutting position speeds have a phase difference of a value obtained by dividing a cycle (360°) by the number A. For example, when the number of the image carriers is three, the phase difference between the periodic variations in the abutting position speeds having the closest phases with each other is 120° (360°×⅓) whether the distance d is equal to "c×⅓" or "c×⅔".

When the number A is an even number, the phase difference is a value obtained by dividing a cycle (360°) by the number A or an integral multiple (within A/2) of the value. For example, when the number of the image carriers is four, the phase difference between the periodic variations in the abutting position speeds having the closest phases with each other is 90° (360°×¼) whether the distance d is equal to "c×¼" or "c×¾". In this case, the phase difference between the periodic variations in the abutting position speeds having the closest phases with each other is 180° (360°×⅔) when the distance a is equal to "c×⅔".

In the image forming apparatus as described above, the phases of the periodic variations of the abutting position speeds are evenly separated. Accordingly, driving forces applied to the intermediate transfer body due to the periodic variations of the image carriers are generated evenly, and thereby the variation in the moving speed of the intermediate transfer body can be reduced.

For example, when the number of the image carriers is two, the more separate the phases of the periodic variations of the abutting position speeds are, the less the periodic variations of the abutting position speed overlap. When the phase difference is a maximum value of 180°, the resultant force of the driving forces by the image carriers can be minimized.

When the number of the image carriers is three, however, if the phase difference of the periodic variations of the abutting position speeds of two image carriers is set to a maximum value of 180°, the phase of the periodic variations of the abutting position speeds of the remaining one image carrier overlaps one of the phases of the periodic variations of the abutting position speeds of the two image carriers (i.e. the phase difference is 0). Then, the resultant force of the driving forces applied to the intermediate transfer body will be increased. That is, even if the resultant force of the driving forces applied to the intermediate transfer body at one point in time is reduced, the resultant force at another point in time will be increased. As a result, variation in the resultant force of the driving forces applied to the intermediate transfer body will be significant.

In contrast, when the phases of the periodic variations are evenly separated as in the present invention, driving forces applied to the intermediate transfer body due to the periodic variations of the image carriers are generated evenly, and thereby the variation in the moving speed of the intermediate transfer body can be reduced.

According to the image forming apparatus of the another aspect of the present invention, especially in the case where the abutting position speeds of the image carriers periodically vary in a sinusoidal manner, driving forces applied in the speed increasing direction of the moving speed of the intermediate transfer body are equal to driving forces applied in the speed decreasing direction, and thus, the resultant force of the driving forces applied to the intermediate transfer body by the image carriers can be minimized.

In the case, for example, where the image forming apparatus is provided with three image carriers, and the abutting position speeds of the image carriers vary in a sinusoidal manner, resulting in driving forces having a maximum value F applied to the intermediate transfer body, a resultant force Fa applied to the intermediate transfer body is indicated by the following formula: $Fa=F\times\sin(\omega t)+F\times\sin(\omega t-120°)+F\times\sin(\omega t-240°)$; ($\omega$: an angular acceleration, t: time). In this case, when the distance d is ⅛ of the circumferential length c, the phase differences among the driving forces applied to the intermediate transfer body equal to a third of a cycle (360°), i.e. 0°, 120° and 240°. The second and third terms in the above formula each having a phase difference within a range of 90° to 270° (i.e. in the speed decreasing direction) may be combined by the addition theorem into a single term of $F\times\sin(\omega t-180°)$. $F\times\sin(\omega t)$ having a phase difference within a range of 270° to 90° (i.e. in the speed increasing direction) and $F\times\sin(\omega t-180°)$ are the same in magnitude and opposite in direction. Accordingly, the resultant force of the driving forces applied to the intermediate transfer body by the image carriers is zero.

This is also applicable not only in the case of two image carriers, but also in the case of four or more image carriers since the driving forces in the speed increasing direction and the driving forces in the speed decreasing direction may be equal in the above described manner.

According to the another aspect of the present invention as described above, even when the periodic variations in the abutting position speeds of the image carriers and the timings of transfer of visual images onto the intermediate transfer body are synchronized the variation in the moving speed of the intermediate transfer body can be reduced to thereby obtain an improved image.

The above described image forming apparatus is an intermediate transfer tandem printer. However, the present invention may be applicable to a so-called direct transfer tandem image forming apparatus. In the direct transfer tandem image forming apparatus, the visual images formed on the outer circumferential surfaces of the image carriers are superimposingly transferred onto a recording medium on which an image is formed.

According to such an image forming apparatus, elongation or shortening of the visual images formed on the recording medium, which is caused due to the periodic variations of the abutting position speeds, occurs at corresponding positions of the visual images, so that a clear image with reduced deviations among the visual images can be obtained.

BRIEF DESCRIPTION OF THE DRAWINGS

A preferred embodiment of the present invention will described hereinafter with reference to the drawings, in which:

FIGS. 6A through 6D are explanatory views for illustrating the printing operation in another modification;

FIGS. 8A through 8D are explanatory views for illustrating printing operation in a further modification;

DETAILED DESCRIPTION OF THE PREFERRED EMBODIMENT

Figure 1:
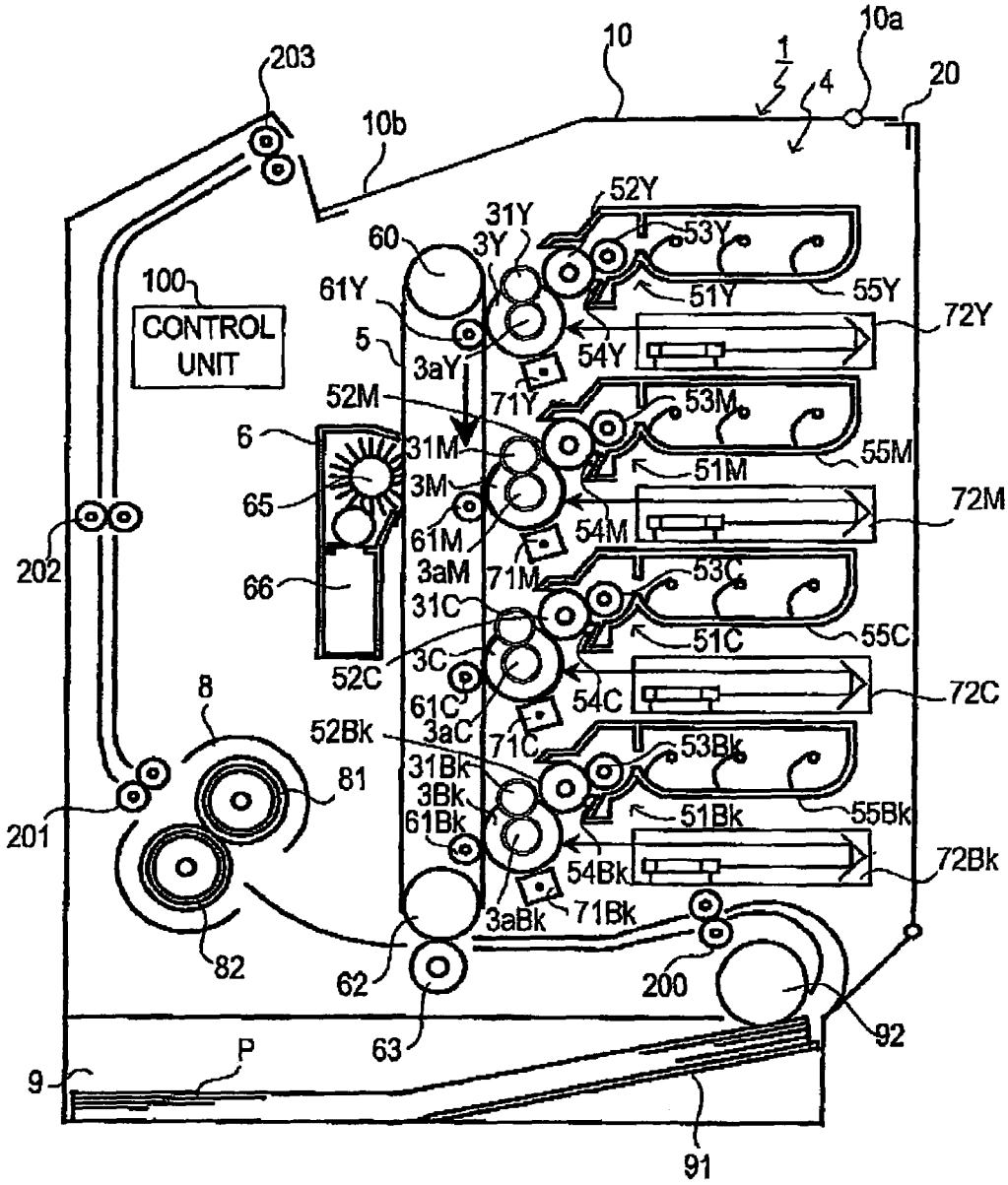
FIG. 1 is a diagrammatic cross-sectional view showing the overall structure of a color laser printer of the present embodiment.

As shown in FIG. 1, a color laser printer 1 is provided with a control portion 100, a toner image forming portion 4, an intermediate transfer belt 5, a fixing portion 8, a paper supply portion 9 and a paper exit tray 10*b*.

The toner image forming portion 4 is provided with photoconductor drums 3Y, 3M, 3C, and 3Bk; chargers 71Y, 71M, 71C, and 71Bk; laser scanner units 72Y, 72M, 72C, and 72Bk; and developing units 51Y, 51M, 51C, and 51Bk for toner image forming processes with respective toners of yellow(Y), magenta(M), cyan(C) and black(Bk). As shown in FIG. 1, components of the toner image forming portion 4 are disposed so as to form toner images in the order of colors of yellow, magenta, cyan and black from top down in the figure.

These components will hereinafter be described in detail.

Each of the photoconductor drums 3Y, 3M, 3C, and 3Bk includes a cylindrical aluminum base material and a positively chargeable photosensitive layer formed on the surface of the aluminum base material. The aluminum base material is used as an earth layer.

The photoconductor drums 3Y, 3M, 3C, and 3Bk are arranged so as to be apart from one another at a distance of ¾ of the circumferential length c ($=\pi\times B$) of the photoconductor drums 3Y, 3M, 3C, and 3Bk.

The photoconductor drums 3Y, 3M, 3C, and 3Bk are provided, at the side ends thereof, with respective gears 3*a*Y, 3*a*M, 3*a*C and 3*a*Bk, and the gears 3*a*Y, 3*a*M, 3*a*C and 3*a*Bk are engaged with gears 31Y, 31M, 31C and 31Bk. The gears 31Y, 31M, 31C and 31Bk ate rotated by a not-shown motor simultaneously and at the same angular speed, thereby rotating the photoconductor drums 3Y, 3M, 3C, and 3Bk in a counterclockwise direction in FIG. 1.

The chargers 71Y, 71M, 71C, and 71Bk, which are scorotron chargers, are arranged under the photoconductor drums 3Y, 3M, 3C, and 3Bk so as not to contact but to face the surfaces of the photoconductor drums 3Y, 3M, 3C, and 3Bk, in order to positively charge the surfaces of the photoconductor drums 3Y, 3M, 3C, and 3Bk.

The laser scanner units 72Y, 72M, 72C, and 72Bk, which are arranged so as to overlap the photoconductor drums 3Y, 3M, 3C, and 3Bk in horizontal directions, emit laser lights from their light sources corresponding to input image data on the downstream side from the chargers 71Y, 71M, 71C, and 71Bk in the rotating directions of the photoconductor drums 3Y, 3M, 3C, and 3Bk. The laser scanner units 72Y, 72M, 72C, and 72Bk emit the laser lights in a scanning manner by, for example, the surfaces of polygon mirrors and irradiate the surfaces of the photoconductor drums 3Y, 3M, 3C, and 3Bk, thereby exposing the surfaces of the photoconductor drums 3Y, 3M, 3C, and 3Bk. Then, electrostatic latent images of respective colors are formed on the surfaces of the photoconductor drums 3Y, 3M, 3C, and 3Bk.

The developing units 51Y, 51M, 51C, and 51Bk include developing unit cases 55Y, 55M, 55C, and 55Bk housing toners therein; developing rollers 52Y, 52M, 52C, and 52Bk as developing agent carriers; supply rollers 53Y, 53M, 53C, and 53Bk; and layer thickness regulating blades 54Y, 54M, 54C, and 54Bk.

Each of the developing rollers 52Y, 52M, 52C, and 52Bk is made of an elastic material such as conductive silicone rubber or conductive urethane rubber as a base material, into a cylindrical configuration, and is provided with a coating layer of resin or rubber material containing fluorine on the surface thereof.

The supply rollers 53Y, 53M, 53C, and 53Bk including conductive sponge rollers are arranged so as to be in press contact with the developing rollers 52Y, 52M, 52C, and 52Bk by the elasticity of the sponge. The supply rollers 53Y, 53M, 53C, and 53Bk may be made of foam of appropriate materials, such as conductive silicone rubber, EPDM, or urethane rubber.

The layer thickness regulating blades 54Y, 54M, 54C, and 54Bk have proximal ends which are made of stainless steel or the like into a plate-like configuration and fixed to the developing unit cases 55Y, 55M, 55C, and 55Bk, and distal ends which are made of insulating silicone rubber, insulating fluorine-containing rubber or resin. The distal ends of the layer thickness regulating blades 54Y, 54M, 54C, and 54Bk are pressed against the developing rollers 52Y, 52M, 52C, and 52Bk from under the developing rollers 52Y, 52M, 52C, and 52Bk.

The toner housed in each of the developing unit cases 55Y, 55M, 55C, and 55Bk contains toner base particles, including positively chargeable non-magnetic one-component developing agent of spherical styrene-acrylic resin formed by suspension polymerization, and additives of a known coloring agent such as carbon black, a charge control agent such as nigrosine, triphenylmethane, quaternary ammonium salt and the like, or a charge control resin. The developing unit cases 55Y, 55M, 55C, and 55Bk respectively house toners of yellow, magenta, cyan and black.

The developing units 51Y, 51M, 51C, and 51Bk supply toners housed in the developing unit cases 55Y, 55M, 55C, and 55Bk through the supply rollers 53Y, 53M, 53C, and 53Bk to the developing rollers 52Y, 52M, 52C, and 52Bk. By using the layer thickness regulating blades 54Y, 54M, 54C, and 54Bk, uniformly thin layers of toners are obtained. Then, positively charged electrostatic latent images formed on the photoconductor drums 3Y, 3M, 3C, and 3Bk are developed by a reversal developing method.

The intermediate transfer belt 5 is an endless belt formed of resin, such as conductive polycarbonate or polyimide, having conductive particles, such as carbon, dispersed therein. As shown in FIG. 1, the intermediate transfer belt 5 is stretched between a drive roller 62 and a follower roller 60, and is abutted by the photoconductor drums 3Y, 3M, 3C, and 3Bk. On the opposite side of the intermediate transfer belt 5 at the abutting positions with the photoconductor drums 3Y, 3M, 3C, and 3Bk, transfer rollers 61Y, 61M, 61C, and 61Bk are provided.

The drive roller 62 includes a metal pipe of iron, aluminum, or the like having a coating of rubber such as EPDM or of urethane and the like on the surface thereof. The drive roller 62 rotationally drives the intermediate transfer belt 5 stretched between the drive roller 62 and the follower roller 60 by friction transmission.

In accordance with the rotation of the drive roller 62, the intermediate transfer belt 5 is rotationally moved at a constant speed determined based on the moving speeds of the outer circumferential surface of the photoconductor drums 3Y, 3M, 3C, and 3Bk, such that the moving direction of the surface of the intermediate transfer belt 5 on a side facing the photoconductor drums 3Y, 3M, 3C, and 3Bk is from up to down in the vertical direction as shown in FIG. 1.

The transfer rollers 61Y, 61M, 61C, and 61Bk, to which predetermined voltages are applied, transfer the toner images formed on the photoconductor drums 3Y, 3M, 3C, and 3Bk onto the intermediate transfer belt 5.

At a position to transfer the toner images to paper P, i.e. at a lower position in the vertical direction with respect to the intermediate transfer belt 5, a secondary transfer roller 63 is provided so as to face the drive roller 62. Since a predetermined voltage is applied also to the secondary transfer roller 63, four color toner images carried on the endless intermediate transfer belt 5 are transferred onto the paper P which passes between the intermediate transfer belt 5 and the secondary transfer roller 63.

On a side of the intermediate transfer belt 5 opposite to the side facing the photoconductor drums 3Y, 3M, 3C, and 3Bk, a cleaning unit 6 is provided as shown in FIG. 1. The cleaning unit 6, including a scratching member 65 and a case 66, scratches toner remaining on the intermediate transfer belt 5 with the scratching member 65 and collets the toner in the case 66.

The paper supply portion 9 provided at the bottom of the image forming apparatus includes a housing tray 91 for housing the paper P and a pickup roller 92 for feeding the paper P. In the paper supply portion 9, the pickup roller 92 is driven at a predetermined timing with image forming process by the laser scanner units 72Y, 72M, 72C, and 72Bk, developing units 51Y, 51M, 51C, and 51Bk, the photoconductor drums 3Y, 3M, 3C, and 3Bk, and the intermediate transfer belt 5, in order to supply the paper P. Then, the paper P supplied from the paper supply portion 9 is conveyed by a pair of conveyer rollers 200 to a pressing portion of the intermediate transfer belt 5 against the secondary transfer roller 63.

The fixing portion 8, including a heating roller 81 and a pressure roller 82, heats and presses the paper P carrying the four color toner images while the paper P is conveyed in a sandwiching manner by the heating roller 81 and the pressure roller 82, thereby to fix the toner images on the paper P.

At the top of the image forming apparatus, a top cover 10 is provided, and a portion of the top cover 10 constitutes the paper exit tray 10*b*. The paper exit tray 10*b* is provided on the paper exit side of the fixing portion 8 so as to receive the paper P discharged from the fixing portion 8 and conveyed by pairs of conveyer rollers 201, 202, and 203.

The control portion 100, including a microcomputer provided with known CPU, ROM, RAM and others, performs various control processing with respect to the operations of the components.

Next, a description will be made about printing operation performed by the color laser printer 1 configured as above, when image data is input from an external personal computer or the like to the control portion 100.

First, the photoconductor drums 3Y, 3M, 3C, and 3Bk are synchronously rotated, and the surface of the photoconductor drum 3Y is uniformly charged by the charger 71Y. Then, the surface is exposed by the laser scanner unit 72Y in accordance with the information of yellow color in the image data input from the external source. As a result, an electrostatic latent image having a reduced potential is formed in the exposed area on the surface of the photoconductor drum 3Y.

Subsequently, in the developing unit 51Y, yellow toner supplied by the supply roller 53Y is applied through the developing roller 52Y to the area of the photoconductor drum 3Y with the electrostatic latent image having a reduced potential, and a toner image is formed on the photoconductor drum 3Y.

The toner image formed in the above manner is transferred onto the surface of the intermediate transfer belt 5 being moved by the rotation of the drive roller 62 by the transfer roller 61Y, to which a transfer bias is applied, when the toner image reaches a point facing the intermediate transfer belt 5 by the rotation of the photoconductor drum 3Y.

The surface of the intermediate transfer belt 5 carrying the transferred toner image is moved by the drive roller 62 and the follower roller 60, and is conveyed sequentially to the abutting positions with the photoconductor drums 3M, 3C, and 3Bk. Then, formation of a toner image and transfer of the toner image in the same manner as in the case of the photoconductor drum 3Y is performed sequentially at each of the abutting positions with the photoconductor drums 3M, 3C, and 3Bk.

The formation of a toner image and the transfer of the toner image is performed such that a delay in the transfer timing between neighboring two of the photoconductor drums 3Y, 3M, 3C, and 3Bk is equal to a time period required for the intermediate transfer belt 5 to move between the neighboring two of the photoconductor drums 3Y, 3M, 3C, and 3Bk, i.e. a time period for ¾ of a rotation of the photoconductor drums 3Y. 3M, 3C, and 3Bk. This enables the toner images formed on the surfaces of the photoconductor drums 3Y, 3M, 3C, and 3Bk to be superimposingly transferred to thereby form a four-color toner image on the surface of the intermediate transfer belt 5.

Subsequently, the four-color toner image formed on the intermediate transfer belt 5 is transferred onto the paper P supplied from the paper supply portion 9 at the pressing portion of the intermediate transfer belt 5 against the secondary transfer roller 63. The paper P is then conveyed to the fixing portion 8 for fixing the toner images, and then conveyed by the pairs of conveyer rollers 201, 202, and 203 to be discharged onto the paper exit tray 10*b*.

Thus, a four-color image corresponding to the input image data is formed on the paper P.

Figure 2:
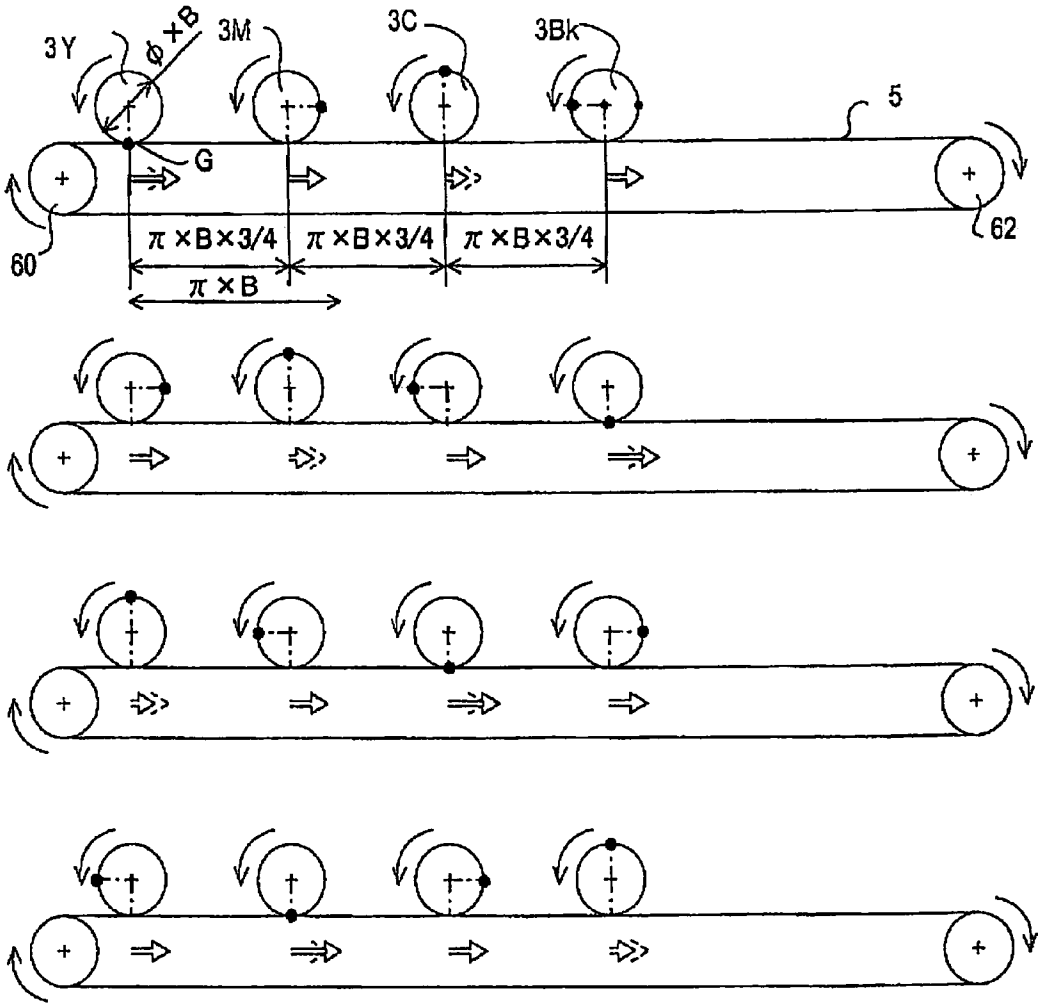
FIGS. 2A through 2D are explanatory views for illustrating printing operation of the present embodiment.

One of the features of the present embodiment in the color laser printer 1 is that the photoconductor drums 3Y, 3M, 3C, and 3Bk are arranged such that the distance between neighboring two of the photoconductor drums 3Y, 3M, 3C, and 3Bk is ¾ of the circumferential length c ($=\pi\times B$) as shown in FIG. 2A.

The resulting operation will be described in detail with respect to the relationship between the abutting position speeds of the photoconductor drums 3Y, 8M, 3C, and 3Bk and the moving speed of the intermediate transfer belt 5 during the above described printing operation.

When the photoconductor drums 3Y, 3M, 3C, and 3Bk are rotated, the abutting position speeds periodically vary due to the variation in the configuration of the photoconductor drums 3Y, 3M, 3C, and 3Bk, pitch errors of gears 31Y, 31M, 31C, and 31Bk, and others.

Figure 3:
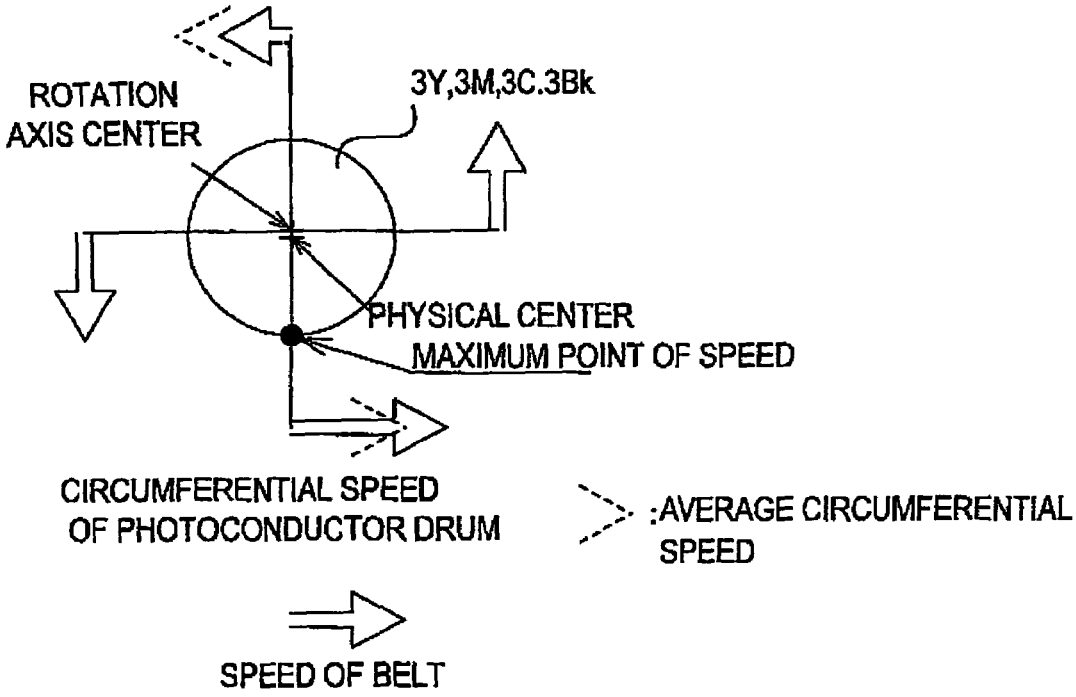
FIG. 3 is an explanatory view for illustrating circumferential speeds of outer circumferential surfaces of photoconductor drums of the present embodiment.

A discussion will be made here concerning a case, as shown in FIG. 3, where the rotation axis center of each of the photoconductor drums 3Y, 3M, 3C, and 3Bk deviates from the physical center, and the distance from the rotation axis to the outer circumferential surface varies depending on the position on the outer circumferential surface. In this case. the abutting position speeds of the photoconductor drums 3Y, 3M, 3C, and 3Bk vary in respective specific cycles (defined as "vary in a sinusoidal manner" here for explanatory purposes). The abutting position speeds are maximum at points farthest from the rotation axis centers (maximum points G) and faster than the moving speed of the intermediate transfer belt 5, while being minimum at points opposite to the maximum points G and slower than the moving speed of the intermediate transfer belt 5.

The photoconductor drums 3Y, 3M, 3C, and 3Bk are arranged as specified below. Specifically, the orientation of the maximum point G, at which the abutting position speed is maximum, of the photoconductor drum 3M is 270° (¾ of a cycle) backward, i.e. 90° forward, with respect to the maximum point G of the photoconductor drum 3Y. In the same manner, the orientation of the maximum point G of the photoconductor drum 3C with respect to the maximum point G of the photoconductor drum 3M, and the orientation of the maximum point G of the photoconductor drum 3Bk with respect to the maximum point G of the photoconductor drum 3C are 270° backward, respectively. In other words, the orientation of the maximum point G of the photoconductor drum 3C is 180° forward with respect to the orientation of the maximum point G of the photoconductor drum 3Y, while the orientation of the photoconductor drum 3Bk is 270° forward with respect to orientation of the maximum point G of the photoconductor drum 3Y.

Figures 4A, 4B:
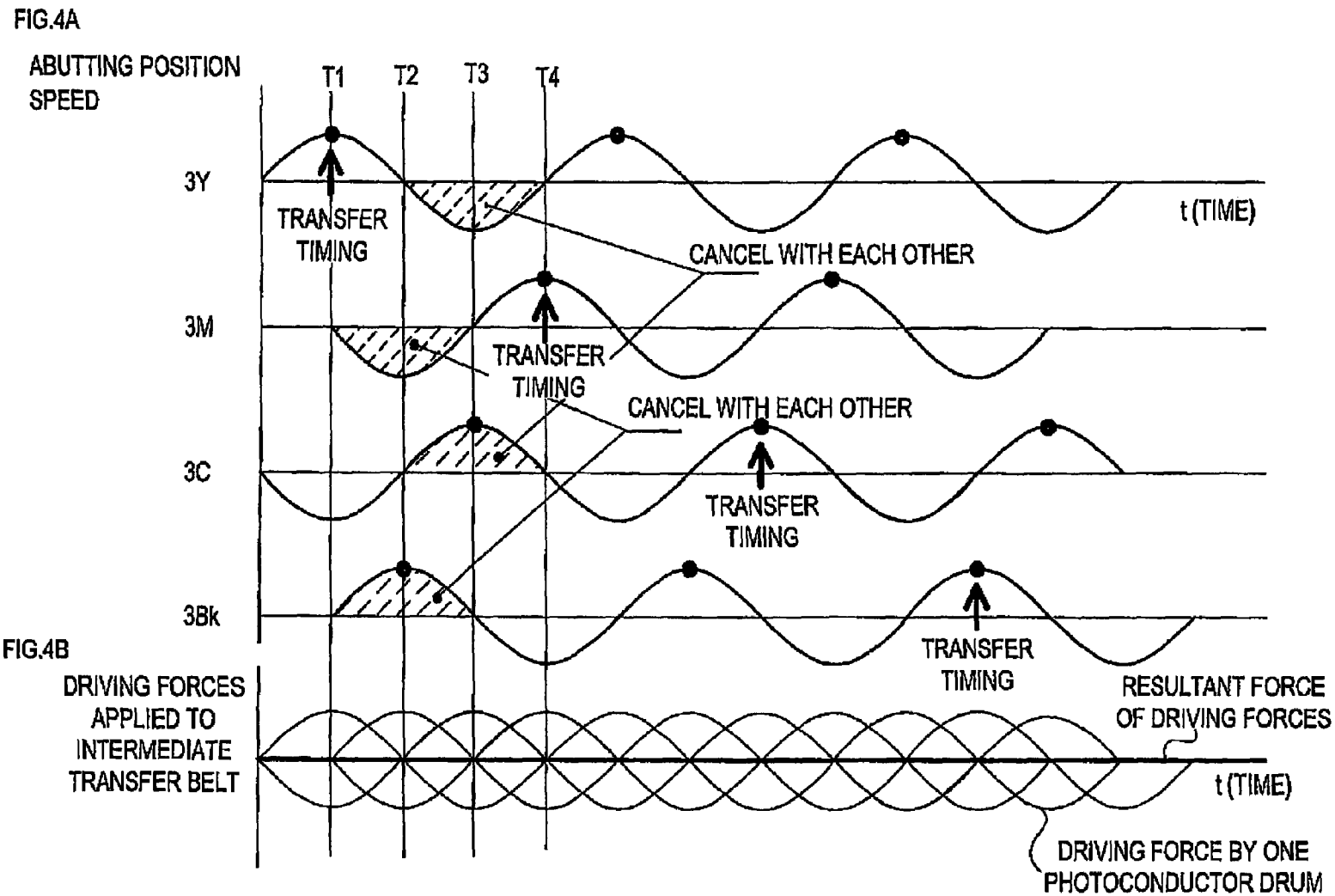
FIGS. 4A and 4B are explanatory views showing abutting position speeds and driving forces of the photoconductor drums of the present embodiment.

Accordingly, the periodic variations of the abutting position speeds of the photoconductor drums 3Y, 3M, 3C, and 3Bk have phase differences of 90°, respectively, as shown in FIG. 4A.

The states of the photoconductor drums 3Y, 3M, 30 and 3Bk at timings T2 through T4 at each 90° rotation of the photoconductor drums 3Y, 3M, 3C and 3Bk starting from a timing T1, shown in FIG. 2A, are shown in FIGS. 2B through 2D. At the timing T2, the photoconductor drums 3Y, 3M, 3C and 3Bk have been rotated by 90°, and the photoconductor drum 3Bk abuts the intermediate transfer belt 5 at the maximum point G. At the timing T3, the photoconductor drums 3Y, 3M, 3C and 3Bk have been rotated by further 90°, and the photoconductor drum 3C abuts the intermediate transfer belt 5 at the maximum point G. At the timing T4, the photoconductor drums 3Y, 3M, 3C and 3Bk have been rotated by 270° from the timing T1, and the photoconductor drum 3M abuts the intermediate transfer belt 5 at the maximum point G. When the photoconductor drums 3Y, 3M, 3C and 3Bk have been rotated by 360° from the timing T1, the photoconductor drums 3Y, 3M, 3C and 3Bk return to the state shown in FIG. 2A. Then, the same process as above is repeated.

The delay in the transfer timing of neighboring two of the photoconductor drums 3Y, 3M, 3C, and 3Bk is a time period for ¾ of a rotation of the photoconductor drums 3Y, 3M, 3C, and 3Bk. Accordingly, a surface of the intermediate transfer belt 5 onto which the toner image is transferred at the maximum point G of the photoconductor drum 3Y abuts the maximum point G of the photoconductor drum 3M at the timing T4, at which the photoconductor drums 3Y. 3M, 3C and 3Bk have been rotated by 270°. The surface of the intermediate transfer belt 5 abuts the maximum point G of the photoconductor drum 3C at a transfer timing, at which the photoconductor drums 3Y, 3M, 3C and 3Bk have been rotated by further 270°, and subsequently abuts the maximum point G of the photoconductor drum 3Bk in the same manner. This is applicable not only to the maximum points G, but also to any points. At the transfer timings at which the toner images formed on the photoconductor drums 3Y, 3M, 3C and 3Bk are transferred, the abutting position speeds of the photoconductor drums 3Y, 3M, 3C and 3Bk are all the same.

When the photoconductor drums 3Y, 3M, 3C, and 3Bk are rotated as described above, driving forces are applied to the intermediate transfer belt 5 due to periodic variations of the abutting position speeds.

At the timing T1, shown in FIG. 2A, the driving force by the photoconductor drum 3Y with the maximum point G abutting the intermediate transfer belt 5 is the largest in a speed increasing direction, while the driving force by the photoconductor drum 3C in the opposite phase to the photoconductor drum 3Y is the largest in a speed decreasing direction. At the timing T1, the photoconductor drums 3M and 3Bk are in a neutral state, applying no driving force.

At the timing T2, shown in FIG. 2B, the driving force by the photoconductor drum 3Bk is the largest in the speed increasing direction, the driving force by the photoconductor drum 3M is the largest in the speed decreasing direction, and the photoconductor drums 3Y and 3C are in a neutral state.

In the periodic variations of the abutting position speeds, the phase difference between the photoconductor drum 3Y and the photoconductor drum 3C, and the phase difference between the photoconductor drum M and the photoconductor drum 3Bk are 180° as described above. Accordingly, the driving forces applied to the intermediate transfer belt 5 due to the periodic variations of the abutting position speeds of the photoconductor drums 3Y, 3M, 3C, and 3Bk cancel one another, and give a resultant force of zero.

According to the color laser printer 1, as described above, the abutting position speeds of the photoconductor drums 3Y, 3M, 3C, and 3Bk can be the same at the transfer timings of the toner images to be superimposingly transferred to the intermediate transfer belt 5. Therefore, elongation or shortening of the toner images of the respective colors formed on the intermediate transfer belt 5, which is caused due to the periodic variations of the abutting position speeds, occurs at the corresponding positions, so that a clear color image with a reduced color deviation can be obtained.

In addition to reducing the color deviation, it is possible to prevent variation in the moving speed of the intermediate transfer belt 5 and thereby to achieve stable image formation by giving a resultant force of zero of the driving forces applied to the intermediate transfer belt 5 due to the periodic variations of the abutting position speeds of the photoconductor drums 3Y, 3M, 3C, and 3Bk.

As in the above embodiment, when the intermediate transfer belt 5 has an endless-belt configuration, a point of the intermediate transfer belt 5 to which a driving force is applied by the drive roller and abutting positions of the intermediate transfer belt 5 with the photoconductor drums 3Y, 3M, 3C, and 3Bk are considerable distances apart. Conveyance of the intermediate transfer belt is likely to be unstable due to the driving forces applied by the periodic variations of the abutting position speeds of the respective photoconductor drums. Especially when the driving force by the drive roller is transmitted to the intermediate transfer belt by friction transmission, it is extremely difficult to maintain a constant conveying speed. Therefore, in the present embodiment, the advantage of reducing the resultant force of the driving forces applied by the periodic variations of the abutting position speeds of the photoconductor drums will be further effective.

In the present embodiment, a discussion has been made about a case where the abutting position speeds periodically vary in a sinusoidal manner, When the abutting position speeds periodically vary not in a sinusoidal manner, the resultant force of the driving forces applied by the photoconductor drums 3Y, 3M, 3C, and 3Bk is not equal to zero. The resultant force of the driving forces, however, can be suppressed since the phase differences of periodic variations in the abutting position speeds are evenly distributed, and the variation in the resultant force can be reduced.

Although one preferred embodiment of the present invention has been described as above, the present invention should not be limited to the specific embodiment, but may be embodied in various forms.

Figure 5:
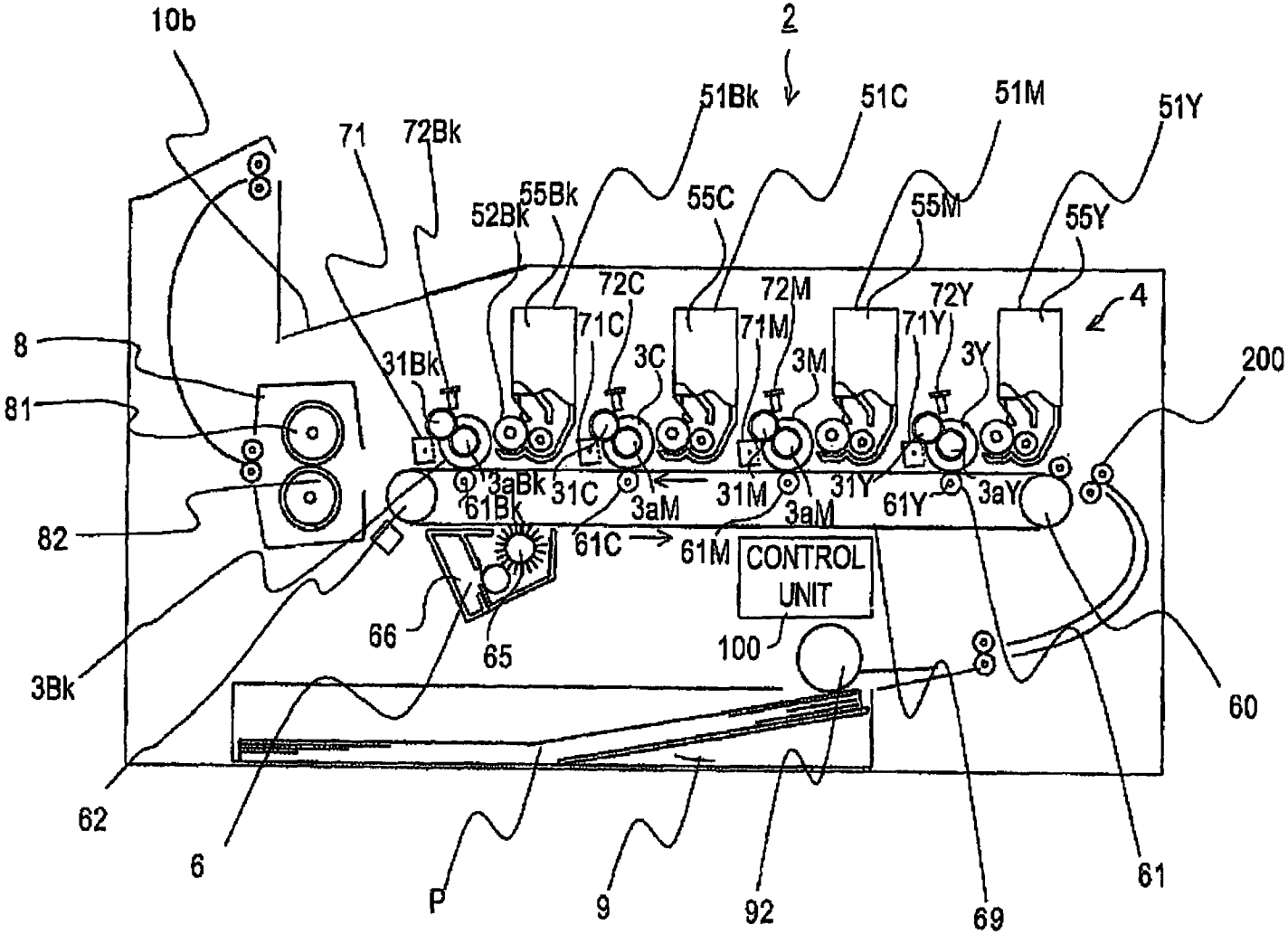
FIG. 5 is a diagrammatic cross-sectional view showing the overall structure of a color laser printer in a modification.

For example, the color laser printer 1 in the present embodiment is configured as an intermediate transfer image forming apparatus, in which the toner images formed on the photoconductor drums 3Y, 3M, 3C, and 3Bk are temporarily transferred onto the intermediate transfer belt 5, and then transferred onto the paper P. However, the present invention may be applied to a color laser printer 2 configured as a direct transfer image forming apparatus shown in FIG. 5. In the color laser printer 2, a paper conveyer belt 4 for carrying paper P is provided instead of the intermediate transfer belt 5, and the paper P is conveyed to points at which the paper conveyer belt 4 and the photoconductor drums 3Y, 3M, 3C, and 3Bk abut with one another, so that toner images are directly transferred to the paper P from the photoconductor drums 3Y, 3M, 3C, and 3Bk. Also in the color laser printer 2, a resultant force of driving forces applied to the paper conveyer belt 4 by the photoconductor drums 3Y, 3M, 3C, and 3Bk can be reduced, and the same advantage as in the present embodiment may be achieved.

The photoconductor drums 3Y, 3M, 3C, and 3Bk having a cylindrical configuration in the present embodiment may be replaced by photosensitive belts having a belt-like configuration and driven by drive rollers.

The intermediate transfer belt 5 having a belt-like configuration as an intermediate transfer body may be replaced by an intermediate transfer drum having a drum-like configuration. In the case of using the endless intermediate transfer belt 5 as in the present embodiment, the drive roller 62, and the abutting positions of the intermediate transfer belt 5 with the photoconductor drums 3Y, 3M, BC, and 3Bk are at considerable distances apart, and the rotation of the drive roller 62 are transmitted to the intermediate transfer belt 5 by friction transmission. As a result, conveyance of the intermediate transfer belt 5 is likely to be unstable due to the driving forces applied by the periodic variations of the abutting position speeds of photoconductor drums 3Y, 3M, 3C, and 3Bk. Therefore, a great advantage may be achieved by applying the present invention to reduce the resultant force of the driving forces, especially in the case of using the endless intermediate transfer belt 5.

While the color laser printer 1 in the present embodiment is configured to form a four-color image by using four photoconductor drums 3Y, 3M, 3C, and 3Bk, the above-described advantage by the present invention may be obtained, as long as the number of photoconductor-drums is two or more.

While, the distance d between neighboring two of the photoconductor drums 3Y, 3M, 3C, and 3Bk is ¾ of the circumferential length c in the present embodiment, the distance d may be selectable, as long as the formula "d=c (M/A+N)" (M: an integer from 1 to "A−1", N: 0 or an integer) is applicable.

Figures 7A, 7B:
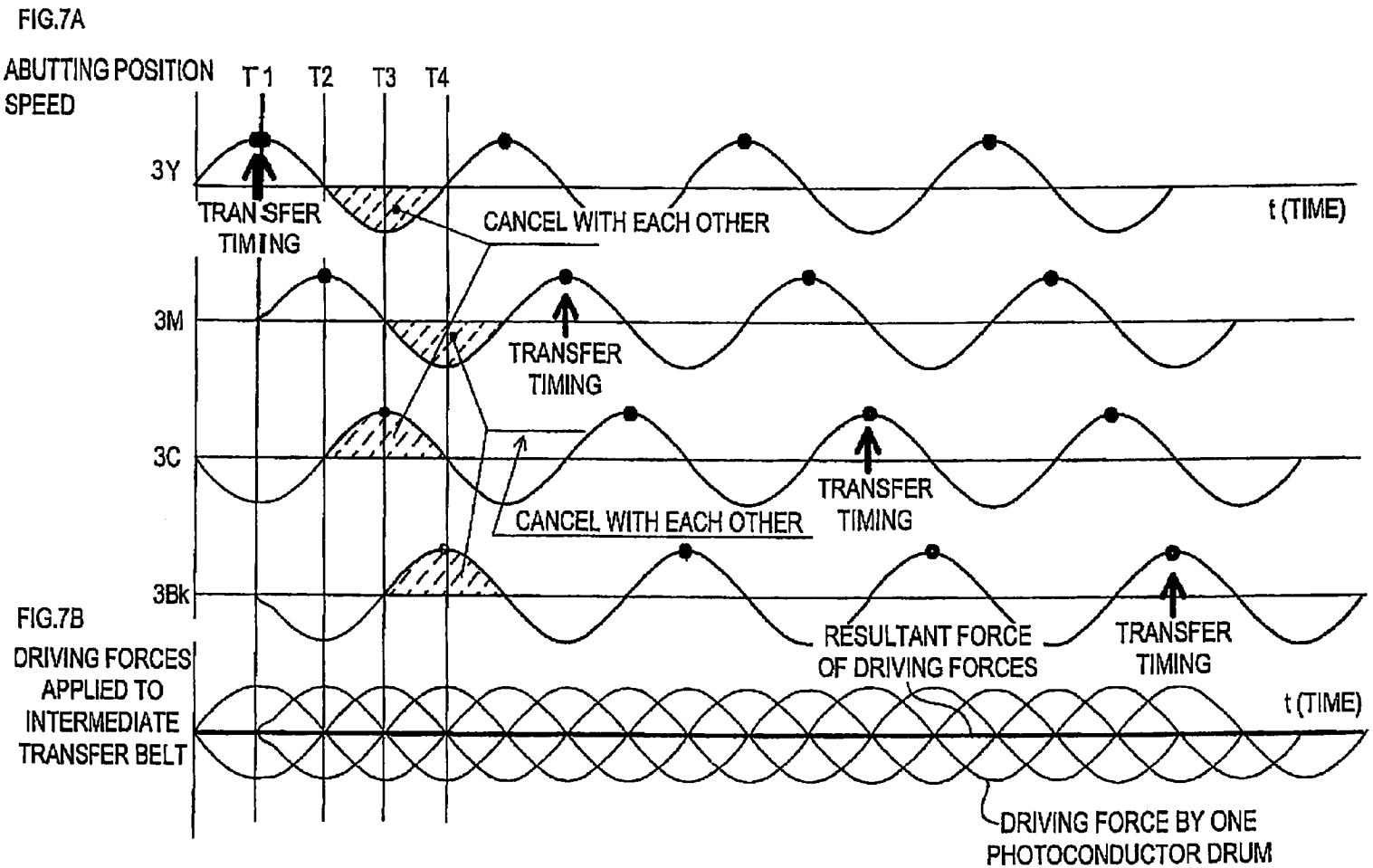
FIGS. 7A and 7B are explanatory views showing abutting position speeds and driving forces of photoconductor drums in the another modification.
Figures 8A, 8B, 8C:
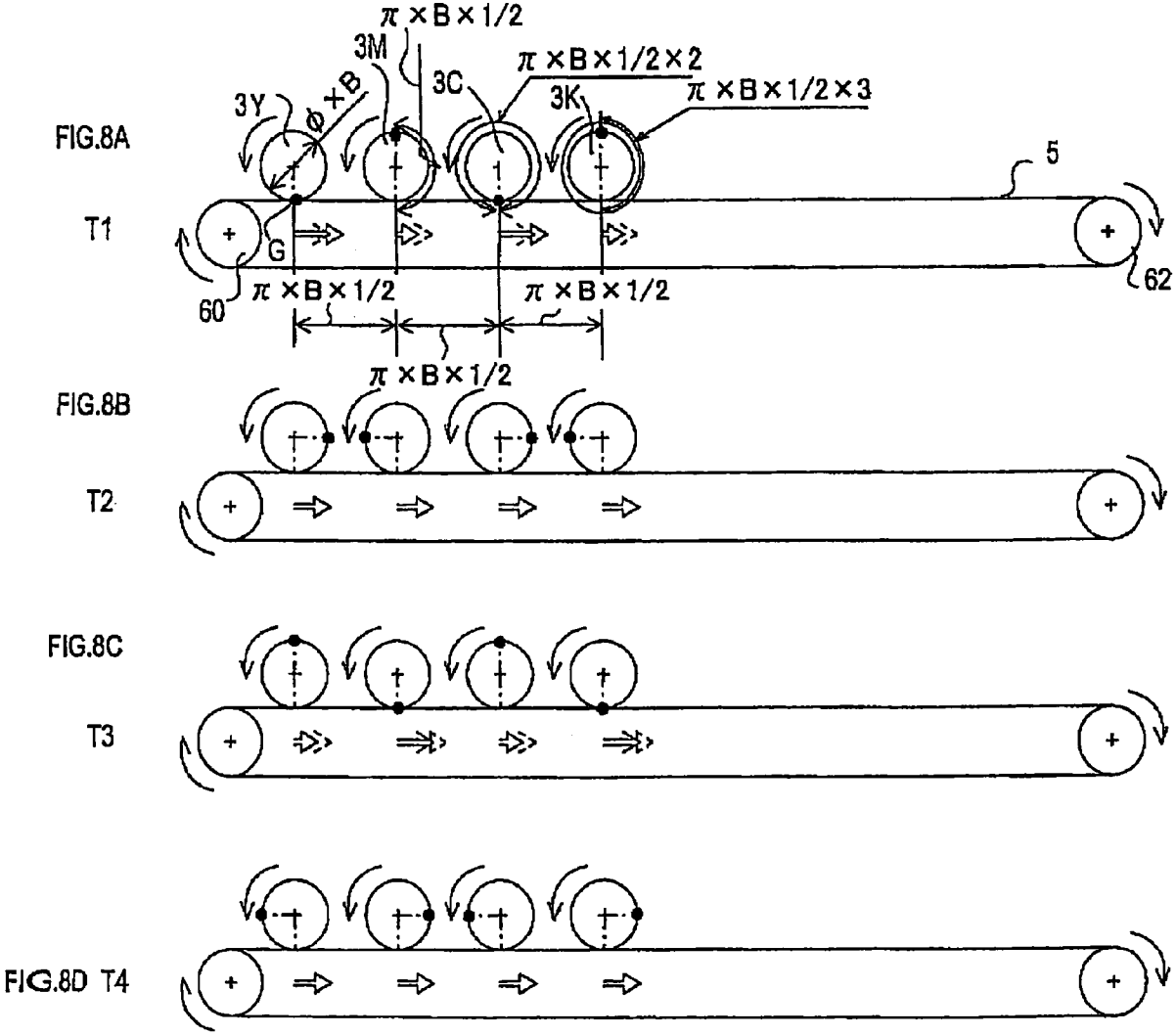

For example, as shown in FIGS. 6A through 6D, when the distance d between neighboring two of the photoconductor drums 3Y, 3M, 3C, and 3Bk is 1 and ¼ of the circumferential length c, the photoconductor drums 3Y, 3M, 3C, and 3Bk are arranged as follows. Specifically, the orientations of the maximum points G of the photoconductor drums 3M, 3C, and 3Bk with respect to the orientation of the maximum point G of the photoconductor drum 3Y are 450° (or 90°), 540° (or 180°), and 630 (or 270°) backward, respectively. Then, in the periodic variations of the abutting position speeds, the phase difference between the photoconductor drum 3Y and the photoconductor drum 3C, and the phase difference between the photoconductor drum 3M and the photoconductor drum 3Bk are 180°. Accordingly, as shown in FIGS. 7A and 7B, the driving forces applied to the intermediate transfer belt 5 due to the periodic variations of the abutting position speeds of the: photoconductor drums 3Y, 3M, 3C, and 3Bk cancel one another, and give a resultant force of zero.

Figures 9A, 9B:
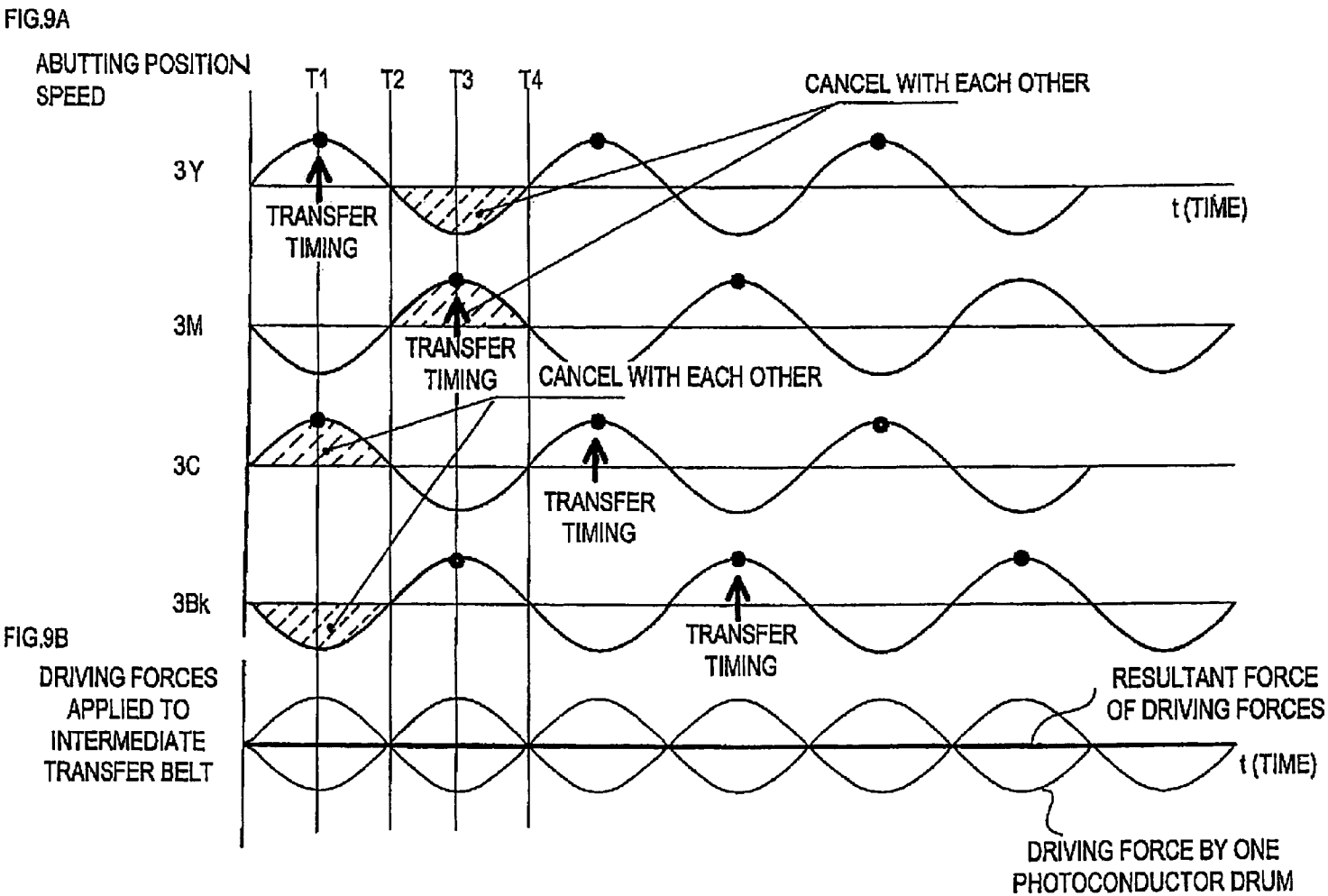
FIGS. 9A and 9B are explanatory views showing abutting position speeds and driving forces of photoconductor drums in the further modification.
Figures 10A, 10B, 10C, 10D:
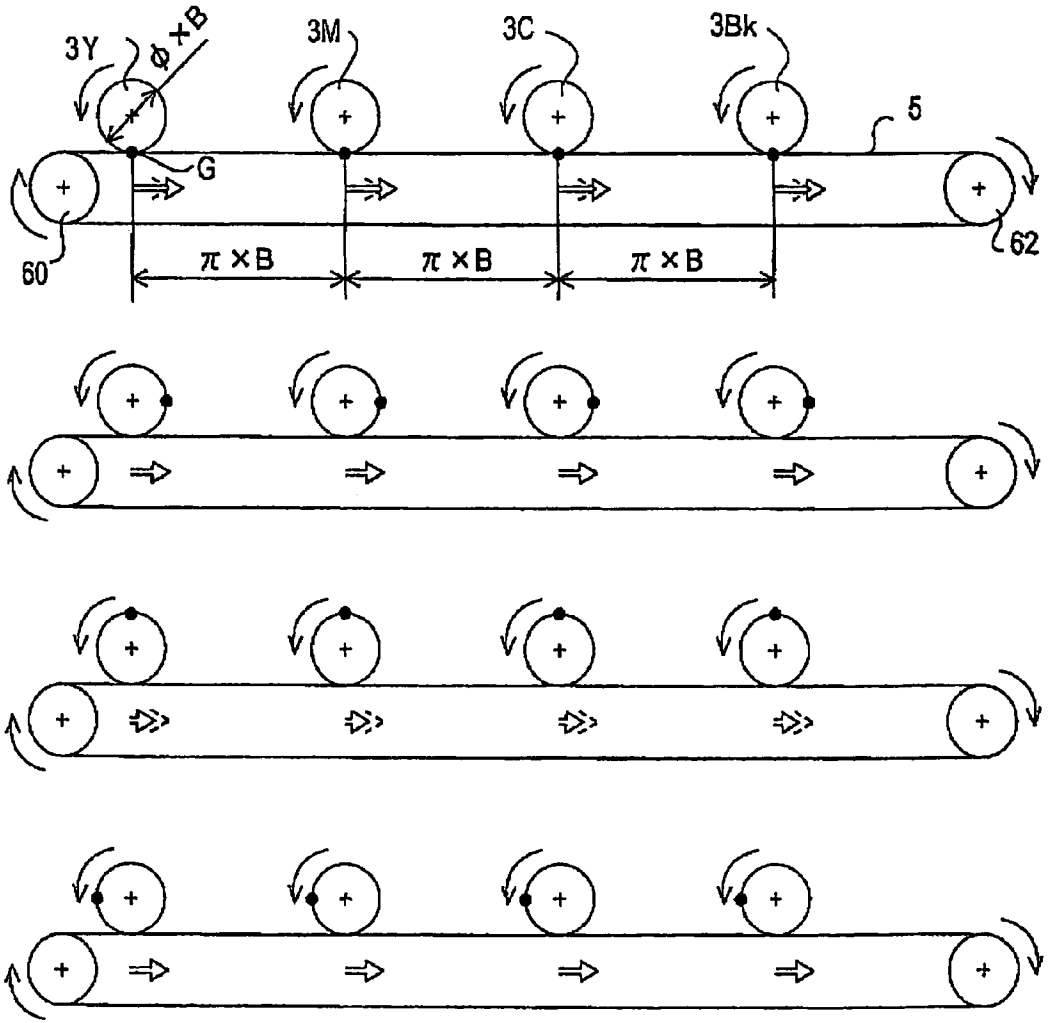
FIGS. 10A through 10D are explanatory views for illustrating printing operation in a conventional form.
Figures 11A, 11B:
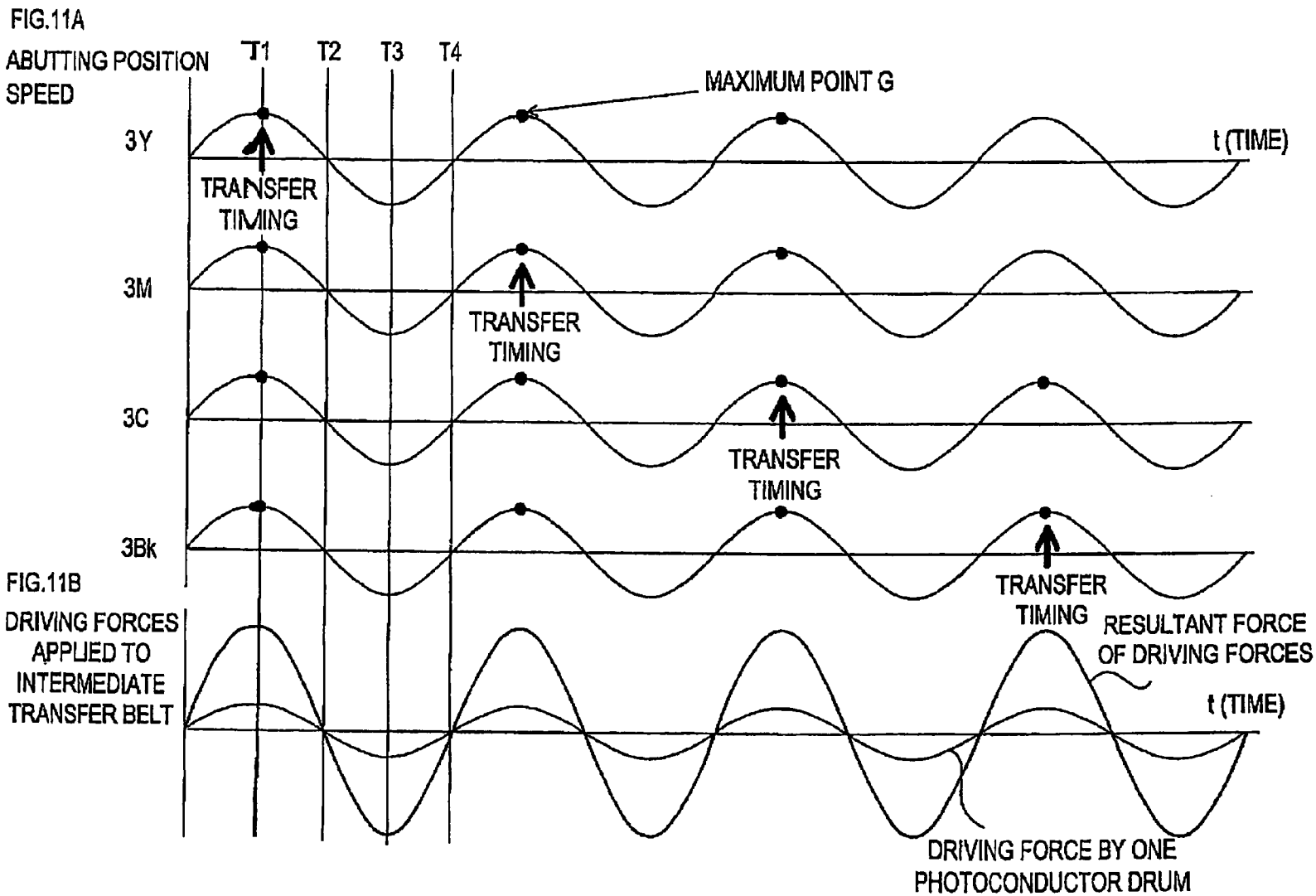
FIGS. 11A and 11B are explanatory views showing abutting position speeds and driving forces of photoconductor drums in the conventional form.

When the distance d between neighboring two of the photoconductor drums 3Y, 3M, 3C, and 3Bk is ½ of the circumferential length c, as shown in FIGS. 8A through 8D, the photoconductor drums 3Y, 3M, 3C, and 3Bk are arranged as follows. Specifically, the orientations of the maximum points G of the photoconductor drums 3M and 3Bk with respect to the orientation of the maximum point G of the photoconductor drum 3Y are 180° backward, while the orientation of the maximum point G of the photoconductor drum 3C is the same as in the photoconductor drum 3Y. Then, in the periodic variations of the abutting position speeds, the phase differences between the photoconductor drum 3Y and the photoconductor drum 3M, and the phase difference between the photoconductor drum 3C and the photoconductor drum 3Bk are 180°. Accordingly, as shown in FIGS. 9A and 9B, the driving forces applied to the intermediate transfer belt 5 due to the periodic variations of the abutting position speeds of the photoconductor drums 3Y, 3M, 3C, and 3Bk cancel one another, and give a resultant force of zero.

When the distance d is equal to or less than the diameter of the photoconductor drums 3Y, 3M, 3C, and 3Bk (i.e. N=0), the photoconductor drums 3Y, 3M, 3C, and 3Bk will contact one another, if arranged in a horizontal direction. To prevent such contact among the photoconductor drums 3Y, 3M, 3C, and 3Bk, the intermediate transfer belt 5 should be arranged to have an arc configuration.

Now, another aspect of the present invention included in the above embodiment is explained on a conceptual basis. The image forming apparatus in one aspect of the present invention comprises: a plurality of image carriers, a driving device, a plurality of visual image forming devices and a conveyer device. The plurality of image carriers which are rotatably supported by rotating shafts carry visual images on outer circumferential surfaces thereof. The driving device rotates the image carriers in circumferential directions. The plurality of visual image forming devices form visual images on the outer circumferential surfaces of the image carriers. The conveyer device moves a medium onto which the visual images are transferred while maintaining abutment of the image carriers with the medium. The conveyer device superimposingly transfers the visual images formed on the outer circumferential surfaces of the image carriers onto the medium, at abutting positions between the medium and the image carriers.

In the image forming apparatus, each of the plurality of image carriers has a rotation axis center and a physical center, as well as an eccentric direction vector having a direction running from the rotation axis center to the physical center. The plurality of image carriers are attached to the rotating shafts in such that the eccentric direction vector of one image carrier cancels the eccentric direction vector of another image carrier, of the plurality of image carriers.

Figure 12:
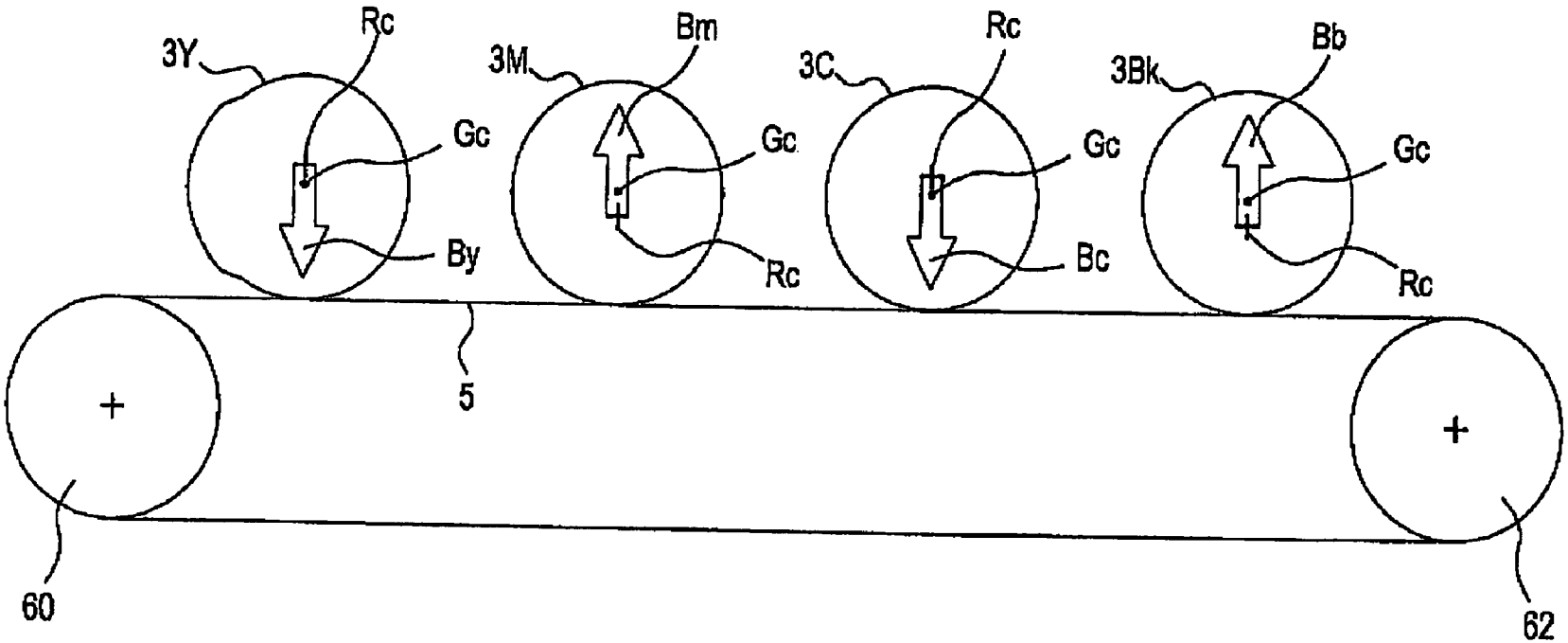
FIG. 12 is an explanatory view illustrating another aspect of the present invention which is included in the embodiment of the present invention.

The eccentric direction vectors of the respective image carriers 3Y, 3M, 3C, and 3Bk are vectors By, Bm, Bc, and Bb directed from a rotation axis center Rc to a physical center Gc, as shown in FIG. 12. FIG. 12 shows the rotating image carriers 3Y, 3M, 3C, and 3Bk in a state at a certain moment. Among these vectors By, Bm, B, and Bb, the vectors By and Bm cancel each other, and the vectors Bc and Bb cancel each other. Also, the vectors By and Bb cancel each other, and the vectors Bm and Bc cancel each other. A sum of these vectors is 0. The respective are attached to the respective rotation axes such that the sum of the vectors is equal to 0.

In the above image forming apparatus, since the eccentric direction vectors of the respective image carriers are cancelled, neither driving force nor braking: force operates between the plurality of image carriers and the medium onto which the visual images are transferred. Accordingly, even if the individual image carriers are eccentrically rotated, the moving speed of the medium onto which the visual images are formed is evenly maintained. Occurrence of deviation in the formed visual imaged is inhibited.

The state of the eccentric direction vectors is not limited to the state shown in FIG. 12. For example, in FIG. 13A, the eccentric direction vectors are arranged so that the vectors By and Bc cancel each other, and the vectors Bm and Bb cancel each other. In FIG. 13B, a pair of the distanced vectors By and Bb cancel each other, and a pair of the adjacent vectors Bm and Bc cancel each other.

Figure 13A:
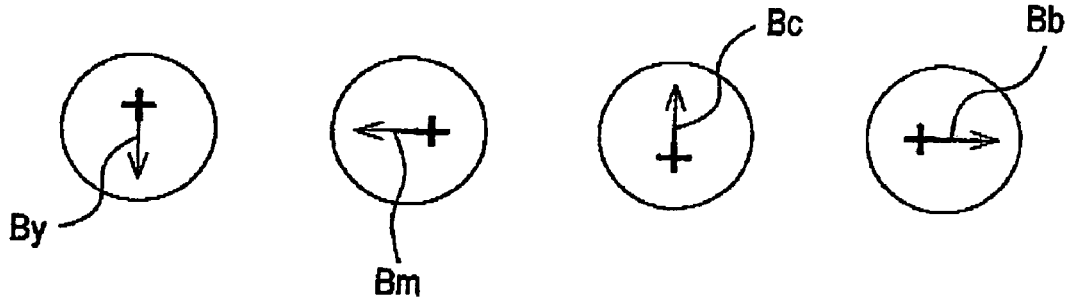
FIGS. 13A and 13B are views illustrating another arrangement of eccentric direction vectors shown in FIG. 12.
Figure 13B:
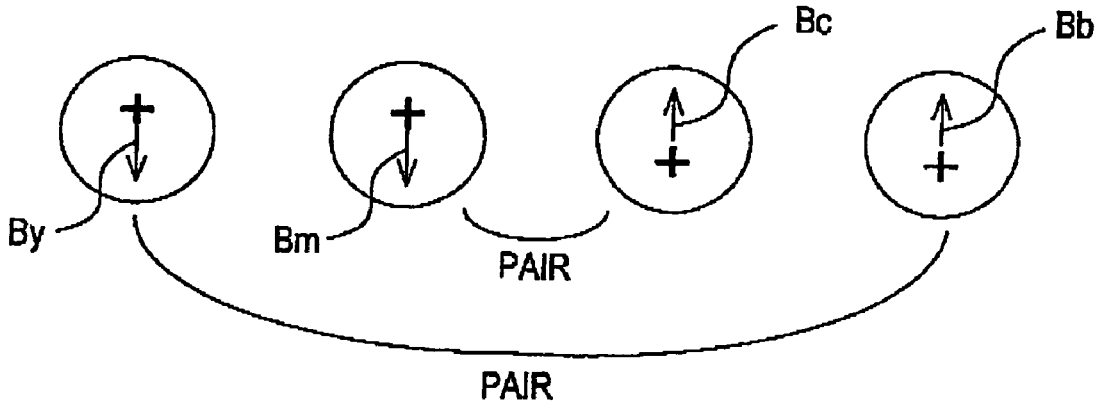

In an example shown in FIG. 13A, the eccentric direction vectors are deviated by a certain angle, e.g., ¾π, between the image carriers adjacent to each other. In an example of FIG. 13B, there are two image carriers directed to the same direction, and two image carriers of which phases are deviated by 180° (these two image carriers have the eccentric direction vectors directed to the same direction).

It is preferable that a distance d between the rotation axis centers is an integral multiple of a value obtained by dividing a circumferential length c of the outer circumferential surface of each of the image carriers by the number A of the carriers, and which is not an integral multiple of the circumferential length c (d=c(M/A+N); M is an integer from 1 to "A−1", and N is 0 or an integer).

What is claimed is:

1. An image forming apparatus comprising:

a plurality of image carriers that carry visual images on outer circumferential surfaces thereof, the plurality of image carriers being rotatably supported by rotating shafts;

a driving device that rotates the image carriers in circumferential directions;

a plurality of visual image forming devices that form visual images on the outer circumferential surfaces of the image carriers; and a conveyer device that moves a medium onto which the visual images are transferred while maintaining abutment of the image carriers with the medium, and superimposingly transfers the visual images formed on the outer circumferential surfaces of the image carriers onto the medium, at abutting positions of the image carriers with the medium, wherein each of the plurality of image carriers has a rotation axis center and a physical center, as well as an eccentric direction vector having a direction running from the rotation axis center to the physical center, wherein the plurality of image carriers are attached to the rotating shafts such that a sum of the eccentric direction vectors of the plurality of image carriers is equal to 0, and wherein a distance between the rotation axis centers is three or five times a value obtained by dividing a circumferential length of the outer circumferential surface of each of the image carriers by the number of the carriers.

2. The image forming apparatus according to claim 1, wherein the plurality of image carriers are attached to the rotation shafts such that the eccentric direction vector of one image carrier cancels the eccentric direction vector of another image carrier, of the plurality of image carriers.

3. The image forming apparatus according to claim 2, wherein the plurality of image carriers include a pair of image carriers of which phases are different from each other by 180°.

4. The image forming apparatus according to claim 1, wherein a distance between the rotation axis centers of a pair of the plurality of image carriers adjacent to each other is equal to a distance between the rotation axis centers of another pair of the plurality of image carriers.

5. The image forming apparatus according to claim 1, wherein the medium onto which the visual images are transferred is an intermediate transfer body.

6. The image forming apparatus according to claim 1, wherein the medium onto which the visual images are transferred is a recording medium.

7. An image forming apparatus comprising:

a plurality of image carriers that carry visual images on outer circumferential surfaces thereof, the plurality of image carriers being rotatably supported by rotating shafts and substantially equally spaced from one another;

a driving device that rotates the image carriers in circumferential directions;

a plurality of visual image forming devices that form visual images on the outer circumferential surfaces of the image carriers in synchronization with rotations of the image carriers; and a conveyer device that moves an intermediate transfer body at a speed in accordance with moving speeds of the outer circumferential surfaces of the image carriers while maintaining abutment of the image carriers with the intermediate transfer body, and superimposingly transfers the visual images formed on the outer circumferential surfaces of the image carriers onto the intermediate transfer body, at abutting positions of the image carriers with the intermediate transfer body, wherein the image carriers are attached to the rotating shafts in orientations such that periodic variations in the moving speeds of the outer circumferential surfaces of the image carriers, which are caused at the abutting positions with the intermediate transfer body, have a phase difference between two of the image carriers corresponding to a time period required for the intermediate transfer body to move between the abutting positions of the two of the image carriers with the intermediate transfer body, and wherein the image carriers are arranged such that a distance between neighboring two of the abutting positions with the intermediate transfer body is a distance which is three or five times a value obtained by dividing a circumferential length of the outer circumferential surface of each of the image carriers by the number of the carriers.

8. The image forming apparatus according to claim 7, wherein the intermediate transfer body is an endless intermediate transfer belt.

9. An image forming apparatus comprising:

a plurality of image carriers that carry visual images on outer circumferential surfaces thereof, the plurality of image carriers being rotatably supported by rotating shafts and substantially equally spaced from one another;

a driving device that rotates the image carriers in circumferential directions;

a plurality of visual image forming devices that form visual images on the outer circumferential surfaces of the image carriers in synchronization with rotations of the image carriers; and a conveyer device that moves a conveyer member carrying a recording medium at a speed in accordance with moving speeds of the outer circumferential surfaces of the image carriers while maintaining abutment of the image carriers with the conveyer member one of directly and through the recording medium, and superimposingly transfers the visual images formed on the outer circumferential surfaces of the image carriers onto the recording medium carried by the conveyer member, at abutting positions of the image carriers with the conveyer member, wherein the image carriers are attached to the rotating shafts in orientations such that periodic variations in the moving speeds of the outer circumferential surfaces of the image carriers, which are caused at the abutting positions with the conveyer member, have a phase difference between two of the image carriers corresponding to a time period required for the conveyer member to move between the abutting positions of the two of the image carriers with the conveyer member, and wherein the image carriers are arranged such that a distance between neighboring two of the abutting positions with the conveyer member is a distance which is three or five times a value obtained by dividing a circumferential length of the outer circumferential surface of each of the image carriers by the number of the carriers.

10. The image forming apparatus according to claim 9, wherein the conveyer member is an endless conveyer belt.

* * * * *